United States Patent [19]

Roman

[11] 4,330,092

[45] May 18, 1982

[54] IN-LINE SHREDDER APPARATUS

[75] Inventor: Walter A. Roman, Norwalk, Conn.

[73] Assignee: The Perkin-Elmer Corporation, Norwalk, Conn.

[21] Appl. No.: 101,391

[22] Filed: Dec. 7, 1979

[51] Int. Cl.[3] ..... B02C 18/18; B02C 18/40

[52] U.S. Cl. ..... 241/232; 83/501; 83/503; 241/167; 241/236

[58] Field of Search ..... 241/167, 232–234, 241/236; 83/500–503

[56] References Cited

U.S. PATENT DOCUMENTS

| | | | |
|---|---|---|---|
| 884,556 | 4/1908 | Bauer | 83/502 |
| 1,525,590 | 2/1925 | Perrault | 83/501 |
| 2,004,085 | 6/1935 | Shaw | 83/500 X |
| 3,786,706 | 1/1974 | Hyatt et al. | 83/503 X |
| 3,960,335 | 6/1976 | Haberle | 241/236 |

FOREIGN PATENT DOCUMENTS

| | | | |
|---|---|---|---|
| 2019932 | 11/1971 | Fed. Rep. of Germany | 241/236 |
| 1264783 | 2/1972 | United Kingdom | 241/236 |

*Primary Examiner*—Howard N. Goldberg
*Attorney, Agent, or Firm*—S. A. Giarratana; E. T. Grimes; T. P. Murphy

[57] ABSTRACT

A shredder includes a pair of blade assemblies operated at high speeds to receive and shred paper material, such as notes or coupons. The blades of the assemblies are disposed to contact and overlap each other. Means are provided to control the amount of overlap and loading of the blades.

4 Claims, 4 Drawing Figures

IN-LINE SHREDDER APPARATUS

BACKGROUND OF THE INVENTION

Shredding machines have taken a wide variety of different forms. Many such machines have included blade assemblies. While such machines have been acceptable for many uses, many such machines have been deficient because of the relative complexity involved in adjusting the blades after the shredder had been used for some time. Other disadvantages of many prior art shredders have involved the difficulties of adjustments, especially after grinding or replacement of assemblies associated with the blades.

When blade assemblies are employed in shredders, the blades in the holding assemblies must be sharpened from time to time and therefore should be easily accessible. They should also preferably be easily removable and interchangeable. After grinding or replacement of the blades, the relative positions of the blades with respect to each other must be readily adjusted to adjust both contact or loading between the blades of the assemblies as well as the amount of overlap between the blades.

In some shredding machines, such as those used for shredding monetary notes, additional considerations are present. It is important in these machines that the shredding be done throughly. The notes are generally individually cut thereby requiring the shredder blades to operate at very high speeds for efficiency. With the high speed of operation, it is important that means be provided to prevent clogging of the relatively closely spaced blades. This is so since the paper which makes up the notes has a high rag content making it difficult to cut cleanly over extended periods of time.

OBJECTS OF THE INVENTION

It is an object of this invention to provide a shredding machine having improved means for controlling the degree of overlap of a plurality of closely spaced cutting blades on blade assemblies.

It is a further object of this invention to provide a shredding machine with improved means for adjusting the loading between the blades of a pair of blade assemblies.

It is still a further object of this invention to provide a shredding machine in which the entire blade assembly may be sharpened at one time, and reinstalled with a minimum amount of adjustment. It is not necessary for individual blades to be sharpened.

It is still a further object of this invention to provide a shredding machine which provides improved means which permits interchanging of the blade assemblies to increase the life of the shredder.

Yet another object of this invention to provide a shredding machine capable of accepting individual notes entering the machine at high speeds (approx 12–15 ft/sec) and cutting the material cleanly into strips.

SUMMARY OF THE INVENTION

In accordance with the present invention, shredding apparatus include a pair of blade assemblies each having a plurality of closely spaced cutting blades disposed to overlap and contact each other. One of the assemblies is adjustable to control the amount of overlap between the blades of the assemblies. Adjustment means are included in this one assembly to control the loading between the blades of the two assemblies. The blade assemblies are rotated at high speeds in opposite directions to perform a shredding operation. Guide members receive the cutting portions of the blades therethrough and guide paper or like material through the exposed cutting edges of the blades and out of the machine after the shredding is performed.

Other objects and advantages of the present invention will be apparent and suggest themselves to those skilled in the art, from reading of the following specification and claims, taken in conjunction with the accompanying drawings.

DETAILED DESCRIPTION OF INVENTION

Figure 1:
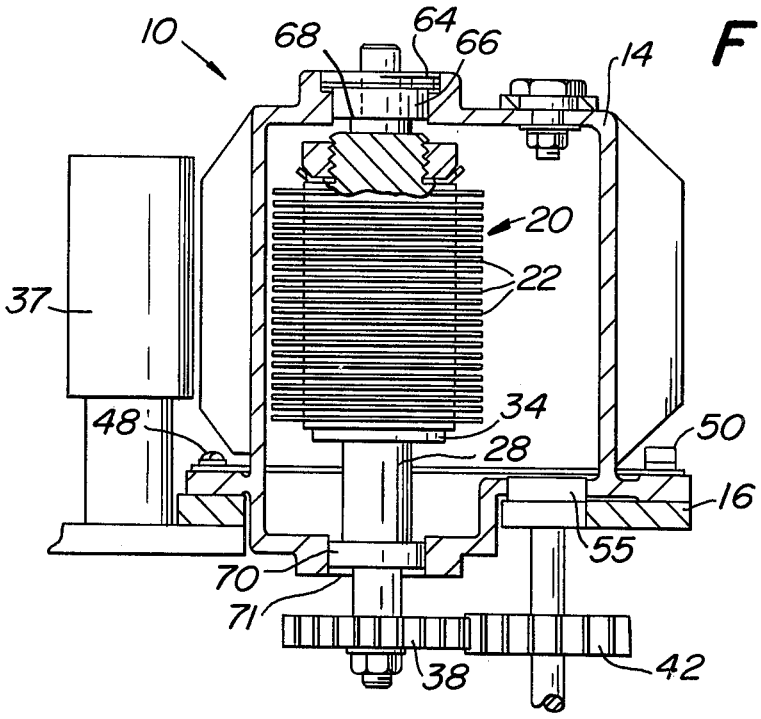
FIG. 1 is a side view, partly in cross section, of a shredding machine, in accordance with the present invention.
Figure 2:
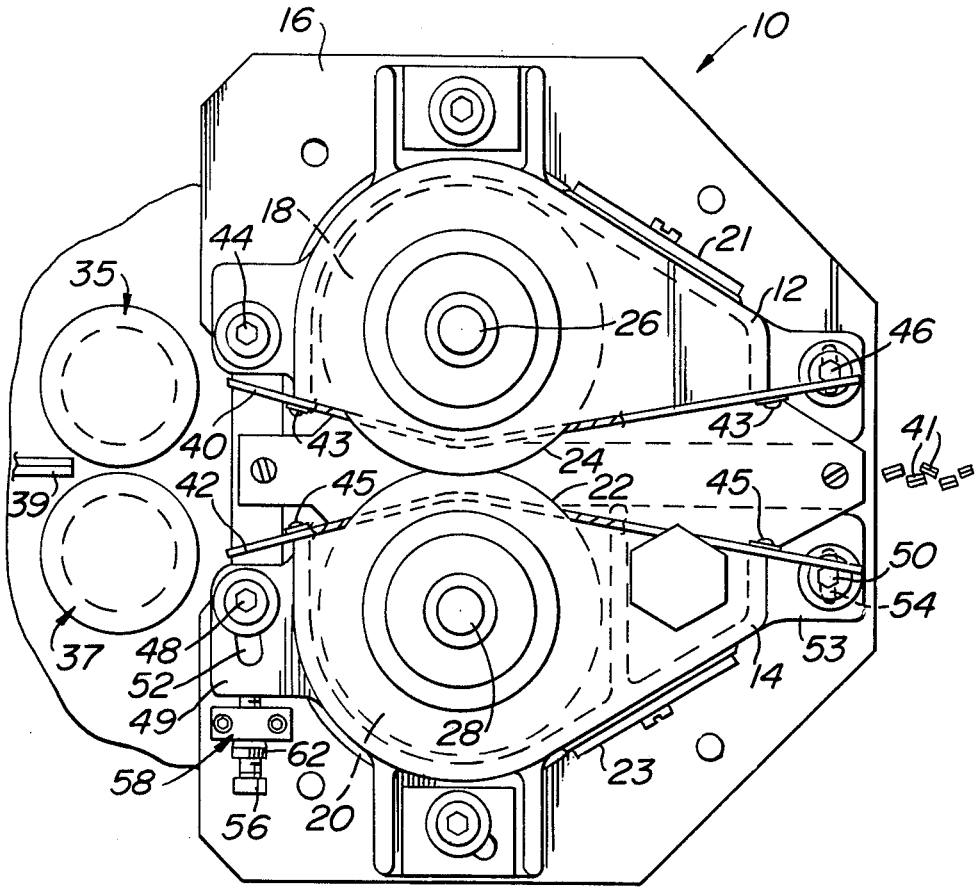
FIG. 2 is a top view of the machine illustrated in FIG. 1.

Referring to FIGS. 1 and 2, a shredding machine 10 comprises a pair of housings 12 and 14. The housing 12 is fixed to the base plate 16 and the housing 14 is pivotally mounted to the base plate 16. Each of the housings 12 and 14 are adapted to receive a blade assembly therein. Removable plates 21 and 23 normally secured to the housings 12 and 14 provide convenient access to the interiors of the housings where desired.

Figure 4:
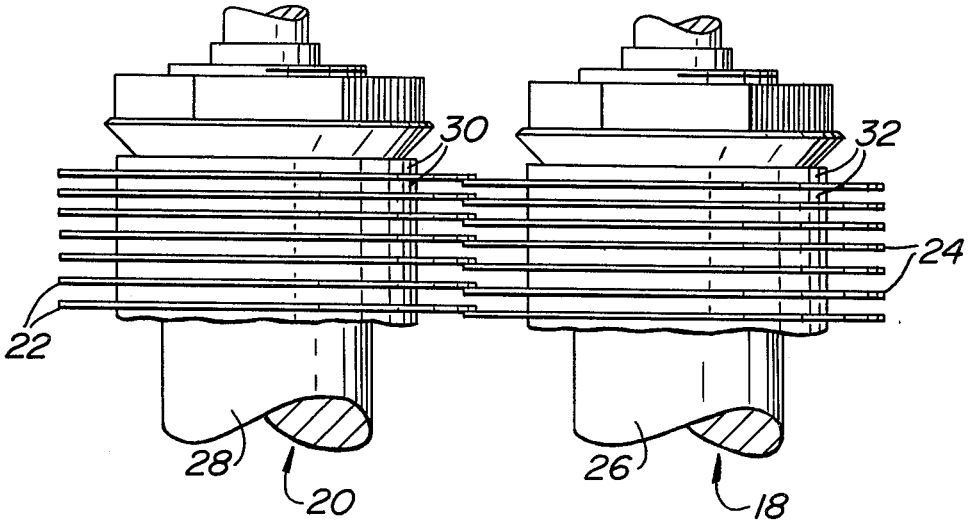
FIG. 4 is an enlarged view illustrating a portion of the blade assembly, in accordance with the present invention.

A blade assembly 18 is rotatably mounted to the housing 12 and a blade assembly 20 is rotatably mounted to the housing 14. Each of the blade assemblies 18 and 20 include a plurality of closely spaced cutting blades. As illustrated in FIG. 4, the blade assembly 20 includes a plurality of blades 22, and the blade assembly 18 includes a plurality of blades 24. The blades 22 are disposed above and overlap the blades 24 slightly, in the order of 0.010 inches, for example, when notes are to be shredded. In order to provide an efficient cutting operation, the blades 22 are loaded slightly downwardly in physical contact with the blades 24. Features of the present invention involve controlling the amount of overlap and controlling the amount of loading between the blades 22 and 24.

The blade assemblies 18 and 20 are adapted to be driven at high speeds by shafts 26 and 28, respectively. The blades 22 are circular and include central openings to fit around shaft 28. Spacing between the blades 22 is maintained by a plurality of spacer rings 30. In like manner, the blades 24 are circular with openings and surround shaft 26, with the spacing being maintained by spacers 32.

The blade assemblies 18 and 20 are substantially the same and are interchangeable. The housings 12 and 14, while similar in some respects, differ with respect to the various means for adjustment associated with the pivotally mounted housing 14.

As illustrated in FIG. 1, the shaft 28 includes a ring 34 to provide a bottom support bearing for the spacers 30 and blades 22 (FIG. 4). The shaft 26 may include a similar arrangement, not illustrated, to support its spacers 32 and blades 24.

Figure 3:
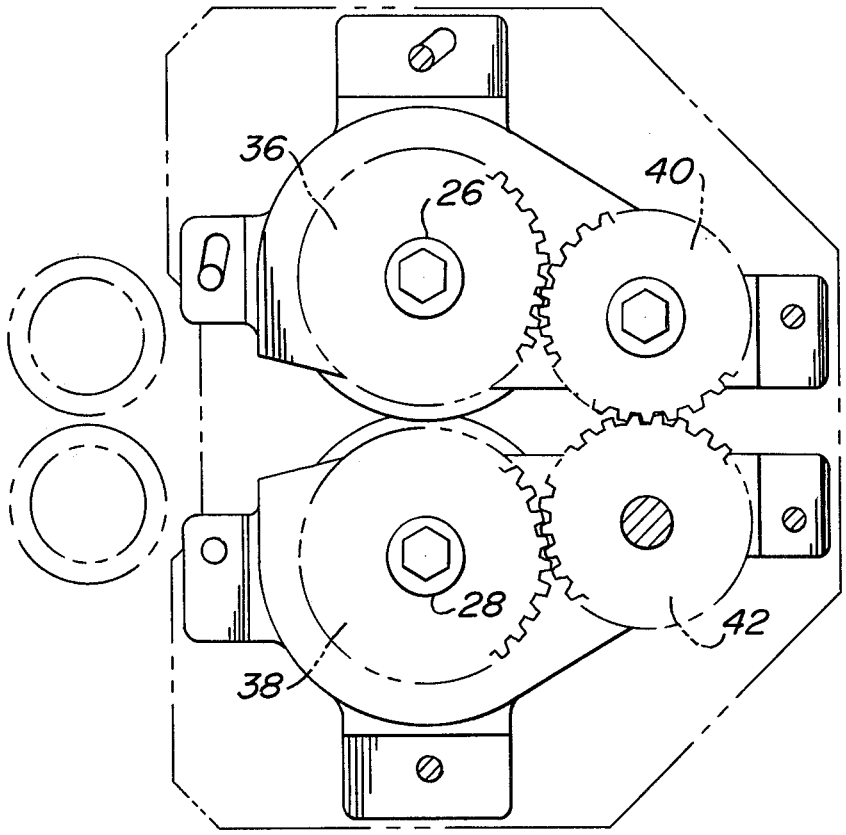
FIG. 3 is a view illustrating, somewhat schematically the means for driving the blade assemblies, in accordance with the present invention.

As illustrated in FIG. 3, the ends of the shafts 26 and 28 are connected to a pair of helical gears 36 and 38, respectively. The gears 36 and 38 are driven by a second set of gears 40 and 42, respectively, driven by a suitable motor, not illustrated. The blade assemblies 18 and 20 connected to the shafts 26 and 28, respectively, are rotated at a relatively high speed by the gears 40 and 42 which drive the respective shafts 26 and 28. The blades 22 and 24 rotate in opposite directions. One of the blade assemblies rotates in a clockwise direction while the other assembly rotates in a counterclockwise direction.

As illustrated in FIG. 2, paper, such as a note 39, driven by rollers 35 and 37, enters between the blade assemblies 18 and 20 from the left. Comb guides 40 and 42 guide the note through the blades of the assemblies with the rotation of the rotation blades pulling the note forward and exiting the shredded particles 41. The guides 40 and 42 surround the blades and prevent shreds from the note from clogging the blade assembly or housings. Cut-outs in the guides are provided to receive therethrough the individual cutting blades with small cutting portions extending through the cut-outs. The guides or plates 40 and 42 are secured to the main body of the housings 12 and 14 by means of suitable screws 43 and 45, respectively. This allows the plates to be removed to permit the blade assemblies to be removed for replacement or interchanging.

The housing 12 is fixed to the base plate 16 by any suitable means such as screws 44 and 46 associated with washers. The shaft 26 (as also illustrated in FIG. 4) is rotatably mounted to the top of the housing 12 at one end and to suitable bearings in the bottom of the housing 12 (not illustrated). The shaft 26, with the associated blade assembly 18, is adapted to be rotated by the helical gear 36 (FIG. 3). The present invention is primarily directed to the features illustrated in connection with the housing 14 and its blade assembly 20.

As illustrated in FIGS. 1 and 2, during operation, the housing 14 is secured in place by means of screws 48 and 50; a third screw (not shown) may be used for holding the housing to the baseplate. The screw 48 extends through an arcuate cut-out 52 in extension 49 which extends from the bottom of the housing 14. The housing 14 is adapted to pivot about a bearing 55 which extends through openings in the base plate 16 and bottom of the housing 14. An enlarged opening 54 is provided in another bottom extension 53 extending from the housing 14 to receive the screw 50.

During an adjustment operation, the screws 48 and 50 may be loosened or removed. The housing 14 is then free to be pivotally moved about the bearing 55. Movement of the housing 14 causes the arcuate cut-out 52 to follow the pivotal movement with the screw 48 in place. Likewise, the enlarged hole 54 accommodates the adjustment movement while still retaining the screw 50. During adjustment, the blades 22 of the blade assembly 20 are moved with respect to the blades 24 of the blade assembly 18 until the degree of desired overlap between the blade assemblies 18 and 20 is reached.

The means for adjusting the housing 14 with respect to the housing 12 is obtained by turning a screw 56 the end of which threadedly engages block 58. The end of the screw 56 bears against the extension 49 of the housing 14 thus causing it to move or pivot about the pivot point or bearing 55. When the proper degree of overlap is obtained, the screw position is locked by a locking nut 62. The screws 48 and 50 are secured in place.

After the proper degree of overlap between the blade assemblies is obtained, it is necessary to preload the blades 22 of the assembly 20 downwardly with respect to the blades 24 of assembly 18 (FIG. 4). To perform an efficient cutting operation, the blades 22 must exert a small force against the blades 24. The loading is accomplished by turning of an adjustment screw 64 disposed toward the top of the shaft 28. The screw 64 exerts a downward pressure through a bearing 66. The pressure from the bearing 66 is exerted against a top extending portion 68 of the main shaft 28. The shaft 28 is adapted to be moved slightly in a vertical direction by means of a bottom extension 70 overcoming the bias of a spring 71, which may be a wavy washer. After the proper loading is obtained, the blades 22 and 24 are ready for a cutting operation.

A feature of the present invention is that, when the shredder blades become dull, the housings 12 and 14 may be removed from the base plate. The blade assemblies 18 and 20 may then be interchanged so that the fixed one becomes the movable housing and vice versa. Blades of the assemblies will now cut on their opposite sides. Thus the worn contact surfaces will be on opposite sides with the unused surfaces of the blades now becoming the cutting contact surfaces. This in effect gives twice the life to the blades before replacement of the blade assemblies is required.

After the blades become dull again as a result of use even after the exchanging referred to above, the blade assemblies may be removed from the housings and the outside diameters ground down a predetermined amount, such as for example 0.025 inches. The blade assemblies may then be reinstalled in the housing, preloaded and overlapping adjustments made and the shredder assembly is ready for installation into the machine. It is noted that all afjustments to the shredding machine may be made offline to the primary machine.

It is best seen that the present invention has provided a shredding machine in which the blades may be periodically sharpened with adjustments made to permit overlapping and preloading. The life of the blades is prolonged by an interchanging of the blade assemblies.

It should be noted that the present invention permits sharpening of the entire blade assembly at one time. The sharpening process involves grinding the outside diameter only. Replacement of the blade assemblies into the housings require no further adjustments except overlap and preload.

What is claimed is:

1. Sherdder apparatus:

a. a base plate b. a first housing fixed to said base plate, c. a second housing, d. bearing means disposed through said second housing and said base plate pivotally mounting said second housing on said base plate, e. screw means disposed through said second housing normally tightened to hold said second housing fixed relative to said first housing, f. a first blade assembly including a plurality of spaced blades connected to said first housing, g. a second blade assembly including a plurality of spaced blades connected to said second housing, h. said first and second housings being disposed with respect to each other so that the blades in said first and second blades assemblies and contact each other, i. a block fixed to said base plate, j. an adjustment screw threadly engaging said second housing through said block to move said housing about said bearing means to vary the amount of overlap between the blades in said first and second blade assemblies when said screw means is loosened, k. means in said second housing to move said second blade assembly axially with respect to said first blade assembly to control the loading in the areas of contact between blades of said first and second blade assemblies, l. means for rotating said first and second blade assemblies to provide a cutting operation, and m. means for directing material to be cut into the area of contact between said blade assemblies.

2. Shredder apparatus as set forth in claim 1 wherein said means to move comprises a screw means disposed to move a spring loaded shaft carrying the blades of said second blade assembly.

3. Shredder apparatus as set forth in claim 2 wherein said means for directing material comprises a pair of guide plates, said guide plates having cut-out portions to receive therethrough the cutting edges of the blades of said first and second blade assemblies.

4. Shredder apparatus as set forth in claim 3 in which said first and second blade assemblies are interchangeable within said first and second housings whereby the contacting surfaces of the blades in said first and second blade assemblies may be reversed.

* * * * *

UNITED STATES PATENT AND TRADEMARK OFFICE

CERTIFICATE OF CORRECTION

PATENT NO. : 4,330,092
DATED : May 18, 1982
INVENTOR(S) : Walter A. Roman

It is certified that error appears in the above-identified patent and that said Letters Patent are hereby corrected as shown below:

Column 1, line 28, change throughly to --thoroughly--,

Column 1, line 55, after invention, insert --is--,

Column 4, line 36, change "afjustments" to --adjustments--,

Column 4, line 50, change "Sherdder" to Shredder--,

Column 4, line 66, after assemblies, insert --overlap--,

Column 5, line 1, change "threadly" to --threadedly--,

Signed and Sealed this

*Twenty-first* Day of *September 1982*

[SEAL]

*Attest:*

GERALD J. MOSSINGHOFF

*Attesting Officer*

*Commissioner of Patents and Trademarks*